US011396681B2

(12) United States Patent
Kano et al.

(10) Patent No.: US 11,396,681 B2
(45) Date of Patent: Jul. 26, 2022

(54) NON-ORIENTED ELECTRICAL STEEL SHEET AND METHOD FOR MANUFACTURING THEREOF

(71) Applicant: NIPPON STEEL & SUMITOMO METAL CORPORATION, Tokyo (JP)

(72) Inventors: Satoshi Kano, Futtsu (JP); Takeaki Wakisaka, Futtsu (JP); Ichiro Tanaka, Himeji (JP)

(73) Assignee: NIPPON STEEL CORPORATION, Tokyo (JP)

( * ) Notice: Subject to any disclaimer, the term of this patent is extended or adjusted under 35 U.S.C. 154(b) by 604 days.

(21) Appl. No.: 15/541,932

(22) PCT Filed: Mar. 10, 2016

(86) PCT No.: PCT/JP2016/057572
§ 371 (c)(1),
(2) Date: Jul. 6, 2017

(87) PCT Pub. No.: WO2016/148010
PCT Pub. Date: Sep. 22, 2016

(65) Prior Publication Data

US 2018/0002776 A1 Jan. 4, 2018

(30) Foreign Application Priority Data

Mar. 17, 2015 (JP) ..... JP2015-053095

(51) Int. Cl.
*C21D 9/46* (2006.01)
*C22C 38/14* (2006.01)
(Continued)

(52) U.S. Cl.
CPC ..... *C21D 9/46* (2013.01); *C21D 6/008* (2013.01); *C21D 8/1222* (2013.01);
(Continued)

(58) Field of Classification Search
CPC ..... C21D 9/46; C22C 38/06
See application file for complete search history.

(56) References Cited

U.S. PATENT DOCUMENTS 8,840,734 B2 * 9/2014 Miyazaki ..... C22C 38/42 148/309
2009/0202383 A1 8/2009 Tanaka et al.
(Continued)

FOREIGN PATENT DOCUMENTS

CN 102007226 A 4/2011
CN 102906289 A 1/2013
(Continued)

OTHER PUBLICATIONS

JP2001-158948 translation (Year: 2001).*
(Continued)

*Primary Examiner* — Anthony J Zimmer
*Assistant Examiner* — Sean P. O'Keefe
(74) *Attorney, Agent, or Firm* — Birch, Stewart, Kolasch & Birch, LLP

(57) ABSTRACT

A non-oriented electrical steel sheet includes C: 0 to 0.0050 mass %, Si: 0.50 to 2.70 mass %, Mn: 0.10 to 3.00 mass %, Al: 1.00 to 2.70 mass %, and P: 0.050 to 0.100 mass %. In the non-oriented electrical steel sheet, Al/(Si+Al+0.5×Mn) is 0.50 to 0.83, Si+Al/2+Mn/4+5×P is 1.28 to 3.90, Si+Al+0.5×Mn is 4.0 to 7.0, the ratio of the intensity of {100} plane I{100} to the intensity of {111} plane I{111} is 0.50 to 1.40, the specific resistance is $60.0\times10^{-8}$ Ω·m or higher at room temperature, and the thickness is 0.05 mm to 0.40 mm.

8 Claims, 1 Drawing Sheet

(51) Int. Cl.

| | |
|---|---|
| ***H01F 1/16*** | (2006.01) |
| ***C22C 38/12*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/00*** | (2006.01) |
| ***C21D 8/12*** | (2006.01) |

(52) U.S. Cl.

CPC ..... *C21D 8/1233* (2013.01); *C21D 8/1272* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *H01F 1/16* (2013.01); *C21D 2201/05* (2013.01)

(56) References Cited

U.S. PATENT DOCUMENTS

| | | | |
|---|---|---|---|
| 2014/0238558 | A1 | 8/2014 | Fujikura et al. |
| 2015/0059929 | A1 | 3/2015 | Zaizen et al. |

FOREIGN PATENT DOCUMENTS

| | | | | |
|---|---|---|---|---|
| CN | 103392021 | A | | 11/2013 |
| JP | 2001-158948 | A | | 6/2001 |
| JP | 2001158948 | A | * | 6/2001 |
| JP | 2001-181806 | A | | 7/2001 |
| JP | 2001-200347 | A | | 7/2001 |
| JP | 2001200347 | A | * | 7/2001 |
| JP | 2003-253404 | A | | 9/2003 |
| JP | 2005-200756 | A | | 7/2005 |
| JP | 2007-247047 | A | | 9/2007 |
| JP | 2010-31328 | A | | 2/2010 |
| JP | 2013010982 | A | * | 1/2013 |
| JP | 2013-36120 | A | | 2/2013 |
| JP | 2013-44008 | A | | 3/2013 |
| JP | 2013-44010 | A | | 3/2013 |
| JP | 2014-210978 | A | | 11/2014 |
| KR | 10-2009-0014383 | A | | 2/2009 |
| KR | 10-2011-0075519 | A | | 7/2011 |
| KR | 10-2011-0075521 | A | | 7/2011 |

OTHER PUBLICATIONS

JP-2001158948-A machine translation (Year: 2001).*
JP-2001200347-A machine translation (Year: 2001).*
JP-2013010982-A English translation (Year: 2013).*
Extended European Search Report dated Jul. 12, 2018, in European Patent Application No. 16764840.1.
Notice of Allowance dated Aug. 28, 2017, in Taiwan Patent Application No. 105107783, with partial English translation.
Notice of Allowance dated Dec. 21, 2018, in Korean Patent Application No. 10-2017-7020820, with English translation.
Office Action dated May 3, 2018, in Chinese Patent Application No. 201680007502.4, with partial English translation.
International Search Report for PCT/JP2016/057572 dated Jun. 14, 2016.
Written Opinion of the International Searching Authority for PCT/JP2016/057572 (PCT/ISA/237) dated Jun. 14, 2016.

* cited by examiner

NON-ORIENTED ELECTRICAL STEEL SHEET AND METHOD FOR MANUFACTURING THEREOF

TECHNICAL FIELD OF THE INVENTION

The present invention relates to a non-oriented electrical steel sheet having a low high-frequency core loss and a method for manufacturing the non-oriented electrical steel sheet at high production efficiency. In more detail, the present invention relates to a non-oriented electrical steel sheet which can be preferably used as a material for a core of electrical machinery and appliances that require high energy efficiency, small size, and high output, and a method for manufacturing thereof. The electrical machinery and appliances are, for example, a compressor motor in an air conditioner, a drive motor mounted in a hybrid vehicle, an electrical vehicle, and a fuel-cell vehicle, and a small generator mounted in a two-wheeled vehicle, and a household cogeneration system.

Priority is claimed on Japanese Patent Application No. 2015-053095, filed Mar. 17, 2015, the content of which is incorporated herein by reference.

RELATED ART

In recent years, it is necessary for electrical machinery and appliances to have smaller size, higher output and higher energy efficiency in order to solve global environmental issues. Therefore, both low core loss and high magnetic flux density are highly necessary for a non-oriented electrical steel sheet (steel sheet) used for a core of electrical machinery and appliances.

In particular, in a drive motor of a hybrid vehicle and an electrical vehicle, the rotation rate of the drive motor is increased in order to compensate for a decrease in torque with every decrease in size. The frequency of a magnetic field applied to a steel sheet also increases with increasing the rotation rate of the drive motor. It causes the core loss to increase. Therefore, it is necessary to reduce the core loss of a steel sheet in a high frequency range (high-frequency core loss). A reduction in sheet thickness, an enhancement of specific resistance and reductions in impurity elements have been adopted as methods for reducing the high-frequency core loss. For example, in Patent Documents 1 to 5, the specific resistance of a steel sheet is increased by increasing the amounts of alloy elements such as Si and Al in the steel sheet.

However, when a large amount of Si and Al are added to steel, cracks and ruptures are more apt to appear during manufacture of a steel sheet, and thereby the productivity and yield decrease. It is effective to reduce the amounts of Si and Al in steel, and thereby to decrease the hardness of the steel in order to preventing the productivity and yield from decreasing. On the other hand, it is necessary to increase the amounts of Si and Al in steel, and thereby to increase the specific resistance in order to further decrease the core loss. The effect of Al on an increase in specific resistance per unit mass is substantially the same effect as Si. However, the effect of Al on an increase in hardness per unit mass is about one third to one half of the effect of Si. Therefore, Al has been used as an element effective in decreasing the core loss without reducing productivity as much as possible. That is, the core loss is further reduced by further increasing the amount of Al in steel. Thus, since it is expected that the amounts of alloy elements are further increased to increase the specific resistance, it is necessary to further improve the productivity.

For example, Patent Document 1 discloses a method of controlling the average grain size and Vickers hardness of an annealed hot band which is manufactured from steel including Si: 1.5 mass % to 3.5 mass % and Al: 0.6 mass % to 3.0 mass %, and having a range of (Al/(Si+Al)) of 0.3 to 0.5. In addition, Patent Document 1 discloses that the method can provide a non-oriented electrical steel sheet having a low high-frequency core loss without reducing the productivity because the rupture resistance of an annealed hot band is enhanced. That is, an adjustment of the ratio of the amount of Al to the total of the amount of Si and the amount of Al (the relative amount of Al) differentiates the method disclosed in Patent Document 1 from the methods disclosed in Patent Documents 2 to 5.

However, the high-frequency core loss increases when the relative amount of Al exceeds a constant value. This may be caused because the hysteresis loss increases with magnetostriction which increases as the relative amount of Al increases.

PRIOR ART DOCUMENT

Patent Document

[Patent Document 1] Japanese Unexamined Patent Application, First Publication No. 2007-247047
[Patent Document 2] Japanese Unexamined Patent Application, First Publication No. 2005-200756
[Patent Document 3] Japanese Unexamined Patent Application, First Publication No. 2003-253404
[Patent Document 4] Japanese Unexamined Patent Application, First Publication No. 2013-44010
[Patent Document 5] Japanese Unexamined Patent Application, First Publication No. 2014-210978

DISCLOSURE OF THE INVENTION

Problems to be Solved by the Invention

The present invention is made in view of the above-described problems, and an object thereof is to provide a non-oriented electrical steel sheet having low high-frequency core loss at high productivity even when the relative amount of Al is further increased to be within a range in which the high-frequency core loss has increased as the hysteresis loss increases so far (a range exceeding an upper limit).

Means for Solving the Problem

The present inventors diligently investigated the change in core loss, in particular, the change in hysteresis loss when various chemical elements are added to steel including a given amount of Al in order to solve the above-described problems. As a result, the present inventors found that the high-frequency core loss does not degrade (does not increase) by the effect of P on the texture of a steel sheet when steel includes a given amount of P even when the relative amount of Al in steel is increased to be within a range in which the high-frequency core loss has increased as the hysteresis loss increases so far. Furthermore, the present inventors found that when a steel sheet has texture in which the ratio of the intensity of {100} plane I{100} to the intensity of {111} plane I{111}, {100}/I{111}, is within a predetermined range, the texture inhibits deformation twinning from forming during punching, and thereby the high-frequency core loss can be further reduced.

In addition, cold rolling becomes easy when the amount of Si decreases and the amount of Al increases. However, when the amount of P increases, cold rolling becomes very difficult. Thus, the present inventors found that a steel sheet can be cold-rolled effectively and stably by properly changing the average grain size of the steel sheet immediately before cold rolling according to solid solution strengthening parameter R even when P makes cold rolling difficult. Furthermore, the present inventors found that I{100}/I{111} can be controlled within a predetermined range by keeping the temperature of a steel sheet at a constant temperature within a predetermined temperature range of a heating stage in final annealing.

The present invention is made on a basis of the above-described findings. The outline of the present invention is as follows.

(1) According to an aspect of the present invention, a non-oriented electrical steel sheet has a chemical composition including: C: 0 to 0.0050 mass %, Si: 0.50 to 2.70 mass %, Mn: 0.10 to 3.00 mass %, Al: 1.00 to 2.70 mass %, P: 0.050 to 0.100 mass %, S: 0 to 0.0060 mass %, N: 0 to 0.0050 mass %, Ti: 0 to 0.008 mass %, V: 0 to 0.008 mass %, Nb: 0 to 0.008 mass %, Zr: 0 to 0.008 mass %, and a balance: Fe and impurities. In the non-oriented electrical steel sheet, the chemical composition satisfies the following expression (1), the following expression (2), and the following expression (3), the intensity of {100} plane I{100} and the intensity of {111} plane I{111} satisfy the following expression (4) when the intensity I{100} and the intensity I{111} are determined by calculating the average of the orientation determination function near a surface and the orientation determination function at a thickness center using pole figures measured by an X-ray diffraction method, the specific resistance is $60.0\times10^{-8}$ Ω·m or higher at room temperature, and the thickness is 0.05 mm to 0.40 mm.

$$0.05\leq Al/(Si+Al+0.05\times Mn)\leq 0.83 \quad (1)$$

$$1.28\leq Si+Al/2+Mn/4+5\times P\leq 3.90 \quad (2)$$

$$4.0\leq Si+Al+0.5+Mn\leq 7.0 \quad (3)$$

$$0.50\leq I\{100\}/I\{111\}\leq 1.40 \quad (4)$$

(2) According to another aspect of the present invention, a method for manufacturing a non-oriented electrical steel sheet includes a hot rolling step subjecting a slab to hot rolling to manufacture a hot band, a cold rolling step subjecting the hot band to cold rolling after the hot rolling step to manufacturing a cold band having a thickness of 0.05 mm to 0.40 mm, a final annealing step subjecting the cold band to final annealing after the cold rolling step. The slab has a chemical composition including: C: 0 to 0.0050 mass %, Si: 0.50 to 2.70 mass %, Mn: 0.10 to 3.00 mass %, Al: 1.00 to 2.70 mass %, P: 0.050 to 0.100 mass %, S: 0 to 0.0060 mass %, N: 0 to 0.0050 mass %, Ti: 0 to 0.008 mass %, V: 0 to 0.008 mass %, Nb: 0 to 0.008 mass %, Zr: 0 to 0.008 mass %, and a balance: Fe and impurities. The chemical composition also satisfies the following expression (5), the following expression (6), and the following expression (7). In the cold rolling step, the average grain size of the hot band before cold rolling D (μm) and the solid solution strengthening parameter R calculated by the following expression (8) satisfy the following expression (9). In a stage in which the cold band is heated in the final annealing step, the temperature of the cold band is maintained for 10 to 300 s at a constant temperature in a range of 550° C. to 700° C.

$$0.50\leq Al/(Si+Al+0.50\times Mn)\leq 0.83 \quad (5)$$

$$1.28\leq Si+Al/2+Mn/4+5\times P\leq 3.90 \quad (6)$$

$$4.0\leq Si+Al+0.5\times Mn\leq 7.0 \quad (7)$$

$$R=Si+Al/2+Mn/4+5\times P \quad (8)$$

[Equation 1]

$$D<4.5\times\left(225-33\times R-\frac{770}{\sqrt{D}}\right) \quad (9)$$

(3) The method for manufacturing the non-oriented electrical steel sheet according to the above (2) may further include a hot band annealing step subjecting the hot band to hot band annealing between the hot rolling step and the cold rolling step.

Effects of the Invention

According to the present invention, it is possible to further decrease the size of electrical machinery and appliances and to further enhance the output and energy efficiency of the electrical machinery and appliances by providing an inexpensive non-oriented electrical steel sheet in which the high-frequency core loss is further improved. In addition, because parts can be more easily punched from the non-oriented electrical steel sheet, it is possible to omit heating the non-oriented electrical steel sheet for punching and to decrease the frequency with which a punch that has worn down is replaced with a new punch. Therefore, it is also possible to reduce the manufacturing cost of the electrical machinery and appliances. Furthermore, according to the present invention, it is possible to stably manufacture a non-oriented electrical steel sheet in which the high-frequency core loss is further improved at a low cost without decreasing the productivity and yield even when an increase in specific resistance of the non-oriented electrical sheet makes cold rolling difficult. Accordingly, the non-oriented electrical steel sheet according to the present invention possesses extremely high industrial merit.

EMBODIMENTS OF THE INVENTION

Figure 1:
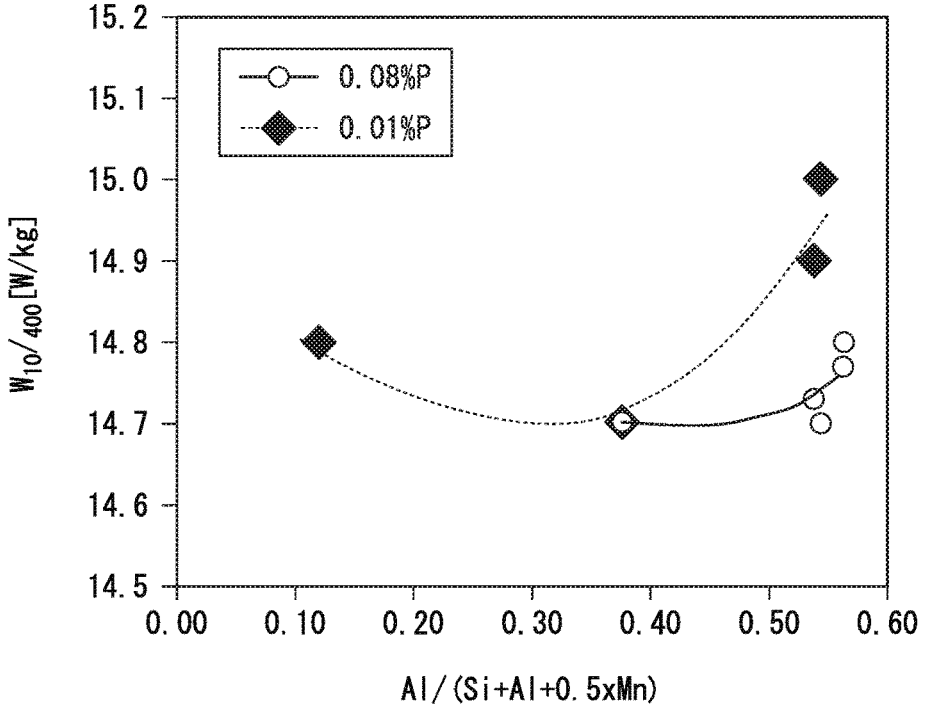
FIG. 1 is a graph showing the effect of the amount of P on the relationship between $W_{10/400}$ and Al/(Si+Al+0.5×Mn).

Hereinafter, a non-oriented electrical steel sheet and a method for manufacturing thereof according to an embodiment of the present invention will be described in detail.

A. Non-Oriented Electrical Steel Sheet

Hereinafter, elements of a non-oriented electrical steel sheet according to an embodiment will be described.

1. Chemical Composition

First of all, the chemical composition of the non-oriented electrical steel sheet according to the embodiment will be described. The following amounts of chemical elements (%) are shown in mass %.

(1) Si: 0.50% to 2.70%

Si increases the specific resistance of a steel sheet, and thereby reduces the core loss of the steel sheet. Therefore, it is necessary that the amount of Si be 0.50% or more. In addition, the amount of Si is preferably 1.00% or more, and more preferably 1.20% or more. On the other hand, when the amount of Si is excessive, a steel sheet may be broken during cold rolling. In addition, in the embodiment, the amount of Si is reduced as much as possible, and the amount of Al is increased, as explained below. Furthermore, because Si inhibits the activity of slip systems of a steel sheet, Si facilitates deformation twinning during deformation. Since the deformation twinning inhibits the movement of domain walls, the hysteresis loss increases with the amount of deformation twinning after punching. From these viewpoints, it is necessary that the amount of Si be 2.70% or less. In addition, the amount of Si is preferably 2.50% or less, and more preferably 2.00% or less. Accordingly, in the non-oriented electrical steel sheet of the embodiment, the amount of Si is 0.50% to 2.70%.

(2) Mn: 0.10% to 3.00%

Since Mn combines with S to form MnS, Mn prevents S from making steel brittle. Therefore, it is necessary that the amount of Mn be 0.10% or more. In addition, Mn as well as Si and Al increase the specific resistance of a steel sheet, and reduce the core loss of the steel sheet. The hardness of high Mn steel is lower than the hardness of high Si steel when the high Mn steel is compared with the high Si steel which has the same specific resistance as the high Mn steel has and has different amounts of Si and Mn from the high Mn steel. Thus, the high Mn steel compares favorably in resistance to rupture during cold rolling with the high Si steel. Therefore, the amount of Mn is preferably 0.50% or more, and more preferably 1.00% or more. However, when the amount of Mn is excessive, the alloy cost increases. From this viewpoint, it is necessary that the amount of Mn be 3.00% or less. In addition, the amount of Mn is preferably 2.50% or less, and more preferably 2.00% or less. Accordingly, in the non-oriented electrical steel sheet of the embodiment, the amount of Mn is 0.10% to 3.00%.

(3) Al: 1.00% to 2.70%

Al as well as Si and Mn increase the specific resistance of a steel sheet, and reduce the core loss of the steel sheet. The effect of Al on an increase in specific resistance per unit mass is substantially the same as the effect of Si. However, the effect of Al on increasing the hardness per unit mass is about one third to one half of the effect of Si. Thus, Al is an important element in the embodiment because both high productivity and high specific resistance can be achieved by increasing the amount of Al. Therefore, it is necessary that the amount of Al be 1.00% or more. In addition, the amount of Al is preferably 1.50% or more, and more preferably 1.60% or more. On the other hand, when the amount of Al is excessive, the saturation magnetic flux density decreases, and thereby the magnetic flux density decreases under the same excitation condition. From this viewpoint, it is necessary that the amount of Al be 2.70% or less. In addition, the amount of Al is preferably 2.50% or less, and more preferably 2.40% or less. Accordingly, in the non-oriented electrical steel sheet of the embodiment, the amount of Al is 1.00% to 2.70%.

(4) P: 0.050% to 0.100%

P improves the texture of a non-oriented electrical steel sheet, and thereby facilitates the magnetization of the steel sheet. In addition, P improves the workability of the steel sheet during punching. Therefore, it is necessary that the amount of P be 0.050% or more. In addition, the amount of P is preferably 0.055% or more, and more preferably 0.060% or more. However, in a non-oriented electrical steel sheet in which the total of the amounts of Si, Mn and Al is large and the specific resistance is high, when the amount of P is more than 0.100%, the rupture may be caused during cold rolling. From this viewpoint, it is necessary that the amount of P be 0.100% or less. In addition, the amount of P is preferably 0.090% or less, and more preferably 0.080% or less. Accordingly, in the non-oriented electrical steel sheet of the embodiment, the amount of P is 0.050 to 0.100%.

(5) Balance

A balance is Fe and impurities.

C is an impurity, and the amount of C may be 0%. When the amount of C is more than 0.0050%, fine carbides precipitate in steel, and thereby the core loss increases significantly. Accordingly, it is necessary that the amount of C be 0% to 0.0050%.

S is an impurity, and the amount of S may be 0%. When the amount of S is more than 0.0060%, a lot of sulfides such as MnS precipitate in steel, and thereby the core loss increases significantly. In addition, since S inhibits the grain growth during final annealing, an appropriate average grain size cannot be obtained, and thereby the core loss may increase when the amount of S is high in steel. Accordingly, it is necessary that the amount of S be 0% to 0.0060%.

N is an impurity, and the amount of N may be 0%. When the amount of N is more than 0.0050%, nitrides increase, and thereby the core loss increases significantly. In addition, N inhibits the grain growth during final annealing, and an appropriate average grain size cannot be obtained, and thereby the core loss may increase when the amount of N is high in steel. Accordingly, it is necessary that the amount of N be 0% to 0.0050%.

Ti, V, Nb, and Zr are impurities, and the amounts of Ti, V, Nb, and Zr each may be 0%. Since Ti, V, Nb, and Zr each have a bad influence on the grain growth during final annealing, it is desirable to reduce the amounts of Ti, V, Nb, and Zr as much as possible. Accordingly, it is necessary that the amounts of Ti, V, Nb, and Zr each be 0% to 0.008%.

(6) The Ratio of the Effect of Al on Specific Resistance to the Effect of Three Chemical Elements (Si, Al, and Mn) on Specific Resistance X: 0.50 to 0.83

In the embodiment, an increase in specific resistance of a steel sheet is substantially proportional to the value of (Si+Al+0.5×Mn), and Al/(Si+Al+0.5×Mn) means the ratio of the effect of Al on specific resistance to the effect of three chemical elements (Si, Al, and Mn) on specific resistance. When the value of (Si+Al+0.5×Mn) is constant and the value of Al/(Si+Al+0.5×Mn) increases, it is possible to reduce the load during cold rolling, and to prevent the rupture of a steel sheet during cold rolling without changing the specific resistance of the steel sheet. Therefore, in the embodiment, Al/(Si+Al+0.5×Mn) is 0.50 or more, i.e., in a range which is determined by the following expression (10). Since the hysteresis loss increases as the ratio of the amount of Al to the total of the amounts of Si and Al increases in the range, the core loss increases in conventional methods. On the other hand, in the embodiment, it is possible to maintain or decrease the core loss by controlling the range of the amount of P and the texture even in a range shown in the following expression (10). In addition, in the embodiment, because it is necessary that the amounts of Si, Al, and Mn be in the above-mentioned range, Al/(Si+Al+0.5×Mn) is 0.83 or less, i.e., in a range shown in the following expression (11). Accordingly, in the embodiment, Al/(Si+Al+0.5×Mn) satisfies the following expression (12). In addition, Al/(Si+Al+0.5×Mn) may be 0.51 or more. Al/(Si+Al+0.5×Mn) may be 0.80 or less. Hereinafter, as shown in the following expression (13), Al/(Si+Al+0.5×Mn) may be indicated as X.

$$Al/(Si+Al+0.5\times Mn)\geq 0.50 \quad (10)$$

$$Al/(Si+Al+0.5\times Mn)\leq 0.83 \quad (11)$$

$$0.50\leq Al/(Si+Al+0.5\times Mn)\leq 0.83 \quad (12)$$

$$X=Al/(Si+Al+0.5\times Mn) \quad (13)$$

Here, in the expressions, chemical symbols indicate the amounts of the corresponding chemical elements in steel (mass %).

(7) Solid Solution Strengthening Parameter R: 1.28-3.90

Si, Al, Mn, and P have a strong effect on solid solution strengthening. When a steel sheet includes excessive amounts of Si, Al, Mn, and P, the steel sheet may break during cold rolling. As shown in the following expression (14), a solid solution strengthening parameter R is defined as a parameter indicating the effect of Si, Al, Mn, and P on solid solution strengthening. In the embodiment, the solid solution strengthening parameter R is 3.90 or less. In addition, in the embodiment, because it is necessary that the amounts of Si, Al, Mn, and P be in the above-mentioned range, the solid solution strengthening parameter R is 1.28 or more. Accordingly, as shown in the following expression (15), the solid solution strengthening parameter R is 1.28 to 3.90. In addition, the solid solution strengthening parameter R may be 1.50 or more, or 2.00 or more. The solid solution strengthening parameter R may be 3.80 or less.

$$R=Si+Al/2+Mn/4+5\times P \quad (14)$$

$$1.28\leq R\leq 3.90 \quad (15)$$

Here, in the expressions, chemical symbols indicate the amounts of the corresponding chemical elements in steel (mass %).

2. Specific Resistance at Room Temperature ρ: $60.0\times10^{-8}$ Ω·m or More

The specific resistance at room temperature is mainly determined by the amounts of Si, Al, and Mn. From the viewpoint of securing low core loss in a high frequency range, it is necessary that the specific resistance be $60.0\times10^{-8}$ Ω·m or more at room temperature. In addition, it is preferable that the specific resistance be $65.0\times10^{-8}$ Ω·m or more at room temperature. The specific resistance may be $85.0\times10^{-8}$ Ω·m or less, or $70.0\times10^{-8}$ Ω·m or less at room temperature.

As shown in the following expression (16), it is necessary that (Si+Al+0.5×Mn) be 4.0 to 7.0 in order to obtain the specific resistance at room temperature. It is more preferable that (Si+Al+0.5×Mn) be 4.4 to 7.0. Hereinafter, as shown in the following expression (17), (Si+Al+0.5×Mn) may be indicated as E.

The specific resistance at room temperature is measured by a known four-terminal method. At least one sample is taken from a position 10 cm or more away from an edge of a steel sheet, insulating coating is removed from the sample, and the specific resistance of the sample is measured. For example, the insulating coating can be removed using alkaline aqueous solution such as 20% aqueous sodium hydroxide.

$$4.0\leq Si+Al+0.5\times Mn\leq 7.0 \quad (16)$$

$$E=Si+Al+0.5\times Mn \quad (17)$$

Here, in the expressions, chemical symbols indicate the amounts of the corresponding chemical elements in steel (mass %).

3. Average Grain Size

It is preferable that the average grain size (the average diameter of crystal grains) of a non-oriented electrical steel sheet be in a range of 30 μm to 200 μm. When the average grain size is 30 μm or more, magnetic flux density and core loss are improved since each recrystallized grain has excellent magnetic properties. In addition, when the average grain size is 200 μm or less, eddy current loss decreases, and thereby the core loss further decreases.

The average grain size of the non-oriented electrical steel sheet (μm) is determined by applying an intercept method to a photograph taken with an optical microscope at 50 times magnification. Three samples are taken from positions 10 cm or more away from an edge of a steel sheet. An intercept method is applied to photographs of a cross-sectional surface (a plane including a thickness direction and a rolling direction; a plane perpendicular to a width direction) of the samples. In the intercept method, the average grain size is determined by averaging the average value of grain size in a rolling direction and the average value of grain size in a thickness direction. The number of crystal grains to be measured is desirably at least 200 per a sample.

4. Ratio of Intensity of {100} Plane I{100} to Intensity of {111} Plane I{111} (I{100}/I{111}): 0.50-1.40

Figure 2:
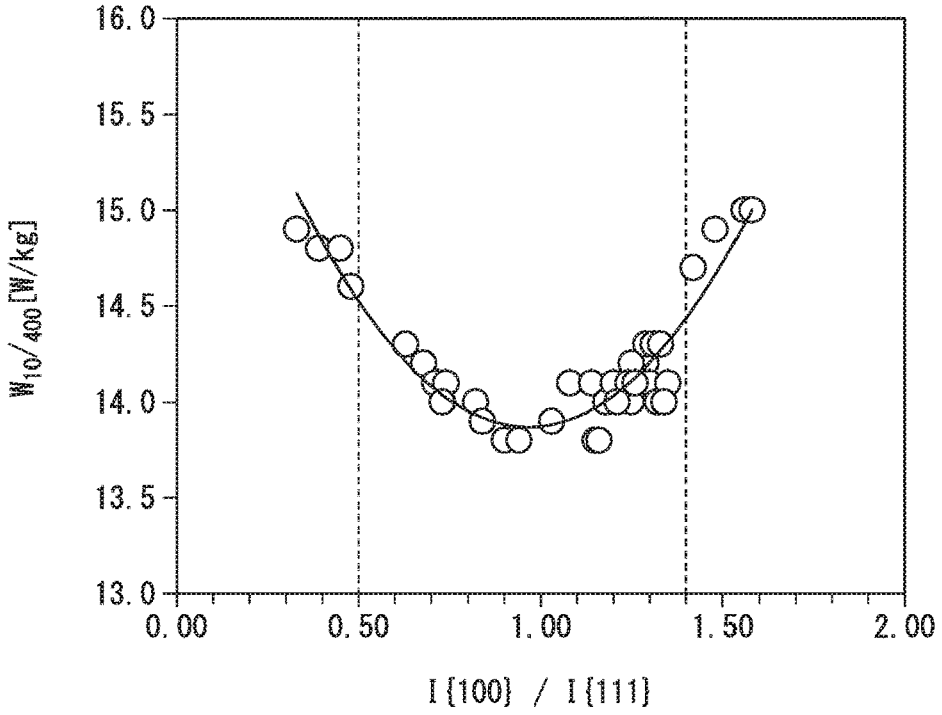
FIG. 2 is a graph showing the relationship between I{100}/I{111} and $W_{10/400}$.

A non-oriented electrical steel sheet according to the embodiment has a texture in which the ratio of the intensity of {100} plane I{100} to the intensity of {111} plane I{111} (I{100}/I{111}) is 0.50 to 1.40, as shown in the following expression (18). As shown in FIG. 2, when I{100}/I{111} is less than 0.50, desirable magnetic properties cannot be obtained, and thereby core loss increases. On the other hand, when I{100}/I{111} is more than 1.40, crystal grains in which deformation twinning forms during punching increase significantly. The deformation twinning inhibits the movement of domain walls. Therefore, the core loss is degraded as shown in FIG. 2. Three samples are taken from positions 10 cm or more away from an edge of a steel sheet. An X-ray diffraction method (reflection method) is applied to a cross-sectional surface (a cross section perpendicular to a thickness direction) of the samples. Positions to be measured in the thickness direction (positions on the cross sectional surface in the thickness direction) are near the surface (positions 1/10 of the thickness of a steel sheet apart from the surface of the steel sheet) and at the center of thickness (positions ½ of the thickness of the steel sheet apart from the surface of the steel sheet). Three pole figures (pole figures of a {200} plane, a {110} plane, and a {211} plane) are measured by a reflection method using an X-ray diffractometer (an X-ray diffraction method) at each thickness position near the surface and at the center of thickness. Orientation determination functions (ODFs) are obtained by a calculation from the pole figures at each thickness position. After that, I{100} and I{111} are determined by averaging the ODF near the surface and the ODF at the center of thickness.

$$0.50\leq I\{100\}/I\{111\}\leq 1.40 \quad (18)$$

5. Thickness of Steel Sheet: 0.05-0.40 mm

In the embodiment, the essential premise is that low core loss is achieved in a high frequency range. When the thickness of a steel sheet is thin, the core loss of the steel sheet is low in a high frequency range. Therefore, it is necessary that the thickness of a steel sheet be 0.40 mm or less. In addition, the thickness of the steel sheet is preferably 0.30 mm or less, and more preferably 0.20 mm or less. On the other hand, when the thickness of a steel sheet is excessively thin, the stacking factor of the steel sheet may decrease enormously by degrading the flatness of the steel sheet, or the productivity of cores may decrease. Therefore, it is necessary that the thickness of a steel sheet be 0.05 mm or more. In addition, the thickness of the steel sheet is preferably 0.10 mm or more, and more preferably 0.15 mm or more.

6. Method for Manufacturing

From the viewpoint of lowering the cost of production, it is preferable that a non-oriented electrical steel sheet according to the embodiment be manufactured by a method for manufacturing a non-oriented electrical steel sheet according to the following embodiment.

B. Method for Manufacturing Non-Oriented Electrical Steel Sheet

Next, each step of a method for manufacturing a non-oriented electrical steel sheet according to an embodiment will be described.

1. Hot Rolling Step

In a hot rolling step, a slab having the above-described chemical composition is subjected to hot rolling to manufacture a hot band.

The hot rolling condition is not limited in particular. It is preferable that the thickness of a hot band (a final thickness of a hot band) be 1.0 mm to 2.5 mm. When the thickness of a hot band is 1.0 mm or more, a load applied to a hot rolling mill is light, and thereby the productivity is high in the hot rolling step.

2. Cold Rolling Step.

In a cold rolling step, after the above hot rolling step, the hot band is subjected to cold rolling to manufacture a cold band.

In cold rolling, it is necessary that a solid solution strengthening parameter R shown in the above expression (14) and an average grain size of a hot band D (μm) satisfy the following expression (19). When the solid solution strengthening parameter R and the average grain size of the hot band D (μm) satisfy the following expression (19), a cold band can be manufactured without breaking the hot band during cold rolling. On the other hand, when the solid solution strengthening parameter R and the average grain size of the hot band D (μm) do not satisfy the following expression (19), a product (a non-oriented electrical steel sheet) cannot be manufactured since the hot band is broken during cold rolling.

[Equation 2]

$$D < 4.5 \times \left(225 - 33 \times R - \frac{770}{\sqrt{D}}\right) \tag{19}$$

The average grain size D (μm) is determined by applying an intercept method to a photograph taken with an optical microscope at 50 times magnification. Three samples are taken from positions 10 cm or more away from an edge of a hot band. An intercept method is applied to photographs of a cross-sectional surface (a plane including a thickness direction and a rolling direction; a plane perpendicular to a width direction) of the samples. In the intercept method, the average grain size is determined by averaging the average value of grain size in a rolling direction and the average value of the grain size in a thickness direction. The number of crystal grains to be measured is desirably at least 200 per a sample.

Here, the average grain size D (μm) is an average grain size of a hot band immediately before cold rolling (a hot band subjected to cold rolling directly). That is, "a steel sheet immediately before cold rolling" means a hot band manufactured by a hot rolling step when a cold rolling step follows the hot rolling step immediately. In addition, as explained below, "a steel sheet immediately before cold rolling" means an annealed hot band obtained by a hot band annealing step (a hot band subjected to hot band annealing) when a hot band annealing step is inserted between a hot rolling step and a cold rolling step.

It is preferable that a cold rolling reduction be 60% to 95%. When the reduction is 60% or more, it is possible to obtain the effect of P on texture of a non-oriented electrical steel sheet more stably. In addition, when the reduction is 95% or less, it is possible to industrially manufacture a non-oriented electrical steel sheet more stably. The thickness of a cold band is reduced to 0.05 mm to 0.40 mm by cold rolling for the reasons suggested earlier in "A. Non-oriented Electrical Steel Sheet."

The temperature of a steel sheet may be room temperature during cold rolling. In addition, the cold rolling may be warm rolling in which the temperature of a steel sheet is 100° C. to 200° C. The steel sheet may be preheated and the roll may be preheated in order to increase the temperature of the steel sheet to 100° C. to 200° C.

In addition, it is preferable that the number of passes be 3 or more in cold rolling. In the cold rolling, it is preferable that the reduction of first pass be 10% to 25%. In addition, it is preferable that the total reduction (cumulative reduction) from first pass to second pass be 35% to 55%. Furthermore, it is preferable that the total reduction (cumulative reduction) from first pass to final pass be 60% to 95%, as explained above. When the reduction of first pass is 10% or more, the manufacturing efficiency of a cold band is high. In addition, when the reduction of first pass is 25% or less, a steel sheet can be passed through between rolls rapidly and stably. When the total reduction from first pass to second pass is 35% or more, a steel sheet can be passed through between rolls rapidly and stably. In addition, when the total reduction from first pass to second pass is 55% or less, the load applied to a cold rolling mill is light.

3. Final Annealing Step

In a final annealing step, after the above cold rolling step, the cold band is subjected to final annealing to manufacture a non-oriented electrical steel sheet.

The final annealing step includes a heating stage in which a cold band is heated, a holding stage in which the temperature of the heated cold band is kept at a constant temperature in a predetermined temperature range, and a cooling stage in which the cold band is cooled after the holding stage. In the heating stage, it is necessary to keep the temperature of the cold band at a constant temperature in a range of 550° C. to 700° C. for 10 to 300 s in an intermediate holding so that the I{100}/I{111} of a non-oriented electrical steel sheet is in a range of 0.50 to 1.40. In the range of 550° C. to 700° C., it is possible to control the amount of crystal grains having a {100} plane on a sheet surface and the amount of crystal grains having a {111} plane on the sheet surface, the sheet surface being a plane parallel to the surface of a steel sheet, i.e., a plane including a rolling direction and a width direction. In addition, when the temperature of a cold band is kept at a constant temperature in the range for a time period shorter than 10 s, it is impossible to obtain a texture in which the I{100}/I{111} is in a range of 0.50 to 1.40, and therefore crystal grains in which deformation twinning forms during punching increase significantly. On the other hand, when the temperature of a cold band is kept at a constant temperature in the range for a time period longer than 300 s, the productivity of a non-oriented electrical steel sheet is low. It is more preferable that the time period for holding be 30 s or shorter in order to further enhance the productivity. In addition, in a temperature range lower than 550° C. and in a temperature range higher than 700° C., no matter how the time period in which the temperature of a cold band is kept at a constant temperature is controlled, appropriate texture cannot be obtained since I{100}/I{111} does not change sufficiently. In the heating stage, after the intermediate holding, the cold band is further heated to a target temperature at which the temperature of the cold band is higher than 700° C. After that, in a holding stage, the temperature of the cold band is kept in a predetermined temperature range including the target temperature. When the temperature range is 1100° C. or lower, the load applied to an annealing facility is light. Therefore, it is preferable that the temperature range be 1100° C. or lower. In addition, it is preferable that the temperature of a cold band be kept in a range of 950° C. or higher for 1 s or longer so that the average grain size of a non-oriented electrical steel sheet is in a range of 30 μm to 200 μm. On the other hand, when the temperature of a cold band is kept in a range of 950° C. or higher for a time period of 300 s or shorter, the productivity is sufficient. As a result, in the holding stage, it is more preferable that the temperature of a cold band be kept in a range of 950° C. to 1100° C. for 1 s to 300 s. In the final annealing, for the reasons suggested earlier in "A. Non-oriented Electrical Steel Sheet," it is preferable that the average grain size be 30 μm to 200 μm after final annealing.

4. Hot Band Annealing Step

In the embodiment, a hot band annealing step may be performed between a hot rolling step and a cold rolling step. In the hot band annealing step, it is possible to further enhance the effect of P on texture in a steel sheet having 1.0% or more Al, and thereby high magnetic flux density and low core loss can be secured more stably. In addition, in the hot band annealing step, the deformation microstructure of a hot band is relieved from strains induced during hot rolling, and thereby the hardness of the hot band decreases. Therefore, the load on a cold rolling mill can be reduced and damages to a steel sheet during cold rolling (for example, occurrence of ridges) can be reduced by the hot band annealing. Accordingly, it is preferable to perform a hot band annealing step in which a hot band manufactured by the above hot rolling step is subjected to hot band annealing.

The hot band annealing step includes a heating stage in which a hot band is heated, a holding stage in which the temperature of the heated hot band is kept in a predetermined range, and a cooling stage in which the hot band is cooled after the holding stage.

A hot band may include deformation microstructure varying according to the rolling condition. In addition, since a hot band includes 1.0% or more Al, the recrystallization is finished in a temperature range of 900° C. to 950° C. Therefore, it is preferable to anneal a hot band in a temperature range of 950° C. or higher in order to obtain recrystallized microstructure from deformation microstructure, and thereby stably prevent a steel sheet from being damaged during cold rolling. In addition, for the same reason, it is preferable that the annealing time be 30 s or longer in the temperature range. When a hot band is annealed at 1100° C. or lower, the load applied to an annealing facility is light. Therefore, it is preferable that the annealing temperature be 1100° C. or lower. When the annealing time is 3600 s or shorter, it is possible to maintain high productivity. Therefore, it is preferable that the annealing time be 3600 s or shorter. In addition, when the solid solution strengthening parameter R is 3.80 or less, and the annealing temperature is 1000° C. or higher, it is possible to further enhance the effect obtained by the expression (19). Therefore, it is preferable that the annealing temperature be 1000° C. or higher.

In addition, in the cooling stage, it is preferable that the average cooling rate be 1° C./s to 30° C./s in a temperature range of 950° C. to 600° C. in order to reduce the grain boundary segregation of P, and thereby further improve the texture.

As a result, in the hot band annealing, it is more preferable that the temperature of a hot band be kept in a range of 950° C. to 1100° C. for 30 s to 3600 s, and then the hot band be cooled so that the average cooling rate is 1° C./s to 30° C./s in a temperature range of 950° C. to 600° C.

The present invention is not limited to the above-described embodiment. The embodiment is merely specific examples. The technical scope of the present invention includes a scope having substantially the same features as the features recited in the claims of the present invention.

EXAMPLES

Hereinafter, reference experiments and examples according to the present invention will be described specifically. In the following tables, when a value in a cell is underlined, the value in the cell does not fulfill the essential requirements of the present invention.

(Reference Experiment 1) the Effect of the Amount of P

Steel Nos. 1 to 10 each having chemical composition shown in the following Table 1 were melted in a vacuum and were casted, and thereby slabs were manufactured. Hot bands having a thickness of 2.0 mm were manufactured by hot rolling the slabs. After that, in hot band annealing, the hot bands were heated to 1000° C., the temperature of the hot bands was kept at 1000° C. for 60 s, and then the hot bands were cooled from 1000° C. to room temperature so that the average cooling rate of each hot band was the corresponding value shown in the following Table 2 in the range of 950° C. to 600° C. After the hot band annealing, cold bands having a thickness of 0.35 mm were manufactured by cold rolling the hot bands. The cold bands were subjected to final annealing in which the temperature of the cold bands was kept at 1050° C. for 1 s. As a result, non-oriented electrical steel sheets (Sample Nos. 1 to 10) were manufactured.

A single sheet 55 mm square was punched out from the non-oriented electrical steel sheet, and the specific resistance at room temperature p m) of the single sheet was measured. In addition, the single sheet was magnetized by applying magnetic flux having a magnetic flux density of 1.0 T to the single sheet at a frequency of 400 Hz, and the high-frequency core loss $W_{10/400}$ (W/kg) of the single sheet was measured. Furthermore, the photograph of the surface of an edge of the single sheet (a surface formed by punching) was taken with an optical microscope at 50 times magnification. The number of crystal grains including deformation twinning was counted in about 300 crystal grains selected from the photograph, and the ratio of the number of crystal grains including deformation twinning to the total number of crystal grains (about 300) (the ratio of twin formation) was calculated. Table 2 shows ρ, $W_{10/400}$, and the ratio of twin formation of Sample Nos. In all Sample Nos., the average grain size of non-oriented electrical steel sheets was about 100 μm.

TABLE 1

| Steel | Chemical Composition [mass %] (Balance: Fe and Other Impurities) | | | | | | | | | |
|---|---|---|---|---|---|---|---|---|---|---|
| No. | Si | Mn | Al | P | C | S | N | X[1)] | R[2)] | E[3)] |
| 1 | 3.00 | 1.30 | 0.50 | 0.011 | 0.0021 | 0.0012 | 0.0019 | 0.12 | 3.63 | 4.2 |
| 2 | 2.30 | 0.97 | 1.70 | 0.010 | 0.0020 | 0.0012 | 0.0018 | 0.38 | 3.44 | 4.5 |
| 3 | 1.90 | 0.50 | 2.50 | 0.012 | 0.0018 | 0.0011 | 0.0019 | 0.54 | 3.34 | 4.7 |
| 4 | 1.40 | 1.40 | 2.50 | 0.009 | 0.0018 | 0.0011 | 0.0020 | 0.54 | 3.05 | 4.6 |
| 5 | 3.00 | 1.30 | 0.50 | 0.077 | 0.0022 | 0.0011 | 0.0018 | 0.12 | 3.96 | 4.2 |
| 6 | 2.30 | 0.97 | 1.70 | 0.078 | 0.0020 | 0.0012 | 0.0018 | 0.38 | 3.78 | 4.5 |
| 7 | 1.90 | 0.50 | 2.50 | 0.077 | 0.0018 | 0.0010 | 0.0023 | 0.54 | 3.66 | 4.7 |
| 8 | 1.40 | 1.40 | 2.50 | 0.079 | 0.0023 | 0.0011 | 0.0020 | 0.54 | 3.40 | 4.6 |
| 9 | 1.00 | 2.00 | 2.57 | 0.081 | 0.0020 | 0.0010 | 0.0019 | 0.56 | 3.19 | 4.6 |
| 10 | 1.73 | 0.60 | 2.62 | 0.080 | 0.0022 | 0.0010 | 0.0018 | 0.56 | 3.59 | 4.7 |

1)X = Al/(Si + Al + 0.5 × Mn)
2)R = Si + Al/2 + Mn/4 + 5 × P
3)E = Si + Al + 0.5 × Mn

TABLE 2

| Sample No. | Steel No. | P [mass %] | X[1)] | R[2)] | Average Cooling Rate [° C./s] | ρ ($\times 10^{-8}$[Q · m]) | $W_{10/400}$ [W/kg] | Ratio of Twin Formation [%] |
|---|---|---|---|---|---|---|---|---|
| 1 | 1 | 0.011 | 0.12 | 3.63 | 23 | 60.7 | 14.8 | 25 |
| 2 | 2 | 0.010 | 0.38 | 3.44 | 24 | 61.8 | 14.7 | 17 |
| 3 | 3 | 0.012 | 0.54 | 3.34 | 24 | 61.8 | 14.9 | 15 |
| 4 | 4 | 0.009 | 0.54 | 3.05 | 22 | 61.5 | 15.0 | 10 |
| 5 | 5 | 0.077 | 0.12 | 3.96 | 23 | | Rupture | |
| 6 | 6 | 0.078 | 0.38 | 3.78 | 24 | 61.8 | 14.7 | 16 |
| 7 | 7 | 0.077 | 0.54 | 3.66 | 24 | 61.8 | 14.7 | 16 |
| 8 | 8 | 0.079 | 0.54 | 3.40 | 23 | 61.5 | 14.7 | 10 |
| 9 | 9 | 0.081 | 0.56 | 3.19 | 19 | 61.2 | 14.8 | 10 |
| 10 | 10 | 0.080 | 0.56 | 3.59 | 22 | 61.5 | 14.8 | 10 |

1)X = Al/(Si + Al + 0.5 × Mn)
2)R = Si + Al/2 + Mn/4 + 5 × P

In the group of Sample Nos. 1 to 4, the amount of P was about 0.01%. When Sample No. 2 is compared with Sample No. 1 in the sample group, $W_{10/400}$ decreased with an increase in ρ. In addition, when Sample No. 3 is compared with Sample No. 2, $W_{10/400}$ increased with an increase in X even when ρ of Sample No. 2 was the same as ρ of Sample No. 3. In the group of Sample Nos. 5 to 10, the amount of P was about 0.08%. In the sample group, when Sample No. 7 is compared with Sample No. 6 having the same ρ as Sample No. 7 had, $W_{10/400}$ was maintained even when X increased. In addition, in Sample No. 5, since the solid solution strengthening parameter R was excessively high, a hot band was broken during cold rolling, and therefore a non-oriented electrical steel sheet was not manufactured. FIG. 1 shows the relationship between $W_{10/400}$ and Al/(Si+Al+0.5×Mn) in each sample group, and makes the effect of the amount of P on the relationship between $W_{10/400}$ and X clear. Sample No. 5 is excluded from FIG. 1. As can be understood from Table 1 and FIG. 1, when the amount of P is about 0.01%, $W_{10/400}$ decreased as X increased until X reached 0.38, whereas the value of $W_{10/400}$ increased as X increased after X increased to more than 0.38. On the other hand, when the amount of P is about 0.08%, low $W_{10/400}$ was maintained even when X increased. Thus, when steel includes at least 0.05% P, the formability of steel can be enhanced while $W_{10/400}$ is maintained since $W_{10/400}$ hardly increases with an increase in X.

In addition, as can be understood from Sample Nos. 1 to 4, when ρ of non-oriented electrical steel sheets was maintained at a high level, the ratio of twin formation increased with an increase in amount of Si. When X is high, the ratio of twin formation can be reduced by decreasing the amount of Si while maintaining ρ at a high level. In this case, it is expected that $W_{10/400}$ can be reduced since magnetic walls moves more easily. However, in Sample Nos. 1 to 4, $W_{10/400}$ did not decrease even when the ratio of twin formation was reduced. In addition, when Sample Nos. 6 to 8 are compared with Sample Nos. 2 to 4, the ratio of twin formation hardly depends on the amount of P. Therefore, it is found that the effect of the amount of P on the relationship between $W_{10/400}$ and X is brought about not by decreasing the ratio of twin formation but by improving texture through an increase in amount of P.

(Reference Experiment 2) The effect of the average grain size D (μm)

Steel Nos. 1, 3, 4, 5, 7, and 8 shown in Table 1 were melted in a vacuum and were casted, and thereby slabs were manufactured. Hot bands having a thickness of 2.0 mm were manufactured by hot rolling the slabs. After that, in hot band annealing, the hot bands were heated to the corresponding annealing temperature shown in the following Table 3, the temperature of the hot bands was kept at the corresponding annealing temperature for 60 s, and then the hot bands were cooled from the corresponding annealing temperature to room temperature so that the average cooling rate of each hot band was the corresponding value shown in the following Table 3 in the range of 950° C. to 600° C.

The average grain size of the annealed hot band (the average grain size of a steel sheet immediately before cold rolling) D (μm) and the surface hardness (Vickers hardness) at 1 kgf Hv (–) were measured. Table 3 shows the average grain size D (μm) and surface hardness Hv (–).

After that, cold bands having a thickness of 0.20 mm (Sample Nos. 1-a to 8-d) were manufactured by cold rolling the annealed hot bands. The number of passes was 5 in the cold rolling. The reduction of first pass was 15%, the total reduction from first pass to second pass was 40%, and the total reduction was 90.0%. Table 3 shows whether there is a rupture in the cold rolling or not.

TABLE 3

| Sample No. | Steel No. | R[1)] | Annealing Temperature [° C.] | Average Cooling Rate [° C./s] | D [μm] | Y[2)] | Hv | Rupture |
|---|---|---|---|---|---|---|---|---|
| 1-a | 1 | 3.63 | 950 | 22 | 88 | 104.1 | 205 | No |
| 1-b | 1 | 3.63 | 1000 | 22 | 113 | 147.5 | 196 | No |
| 1-c | 1 | 3.63 | 1050 | 23 | 130 | 169.5 | 191 | No |
| 1-d | 1 | 3.63 | 1100 | 25 | 148 | 188.6 | 187 | No |
| 3-a | 3 | 3.34 | 950 | 20 | 84 | 139.2 | 197 | No |
| 3-b | 3 | 3.34 | 1000 | 21 | 110 | 186.9 | 187 | No |
| 3-c | 3 | 3.34 | 1050 | 23 | 125 | 207.3 | 182 | No |
| 3-d | 3 | 3.34 | 1100 | 23 | 144 | 228.5 | 178 | No |
| 4-a | 4 | 3.07 | 950 | 21 | 83 | 176.3 | 186 | No |
| 4-b | 4 | 3.07 | 1000 | 21 | 116 | 234.9 | 173 | No |
| 4-c | 4 | 3.07 | 1050 | 22 | 132 | 255.0 | 169 | No |
| 4-d | 4 | 3.07 | 1100 | 23 | 150 | 273.7 | 165 | No |
| 5-a | 5 | 3.96 | 950 | 20 | 79 | 33.9 | 220 | Yes |
| 5-b | 5 | 3.96 | 1000 | 21 | 117 | 103.4 | 205 | Yes |
| 5-c | 5 | 3.96 | 1050 | 23 | 129 | 118.6 | 202 | Yes |
| 5-d | 5 | 3.96 | 1100 | 24 | 150 | 140.8 | 197 | Yes |
| 7-a | 7 | 3.66 | 950 | 20 | 75 | 68.1 | 211 | Yes |
| 7-b | 7 | 3.66 | 1000 | 20 | 120 | 151.9 | 195 | No |
| 7-c | 7 | 3.66 | 1050 | 22 | 139 | 174.4 | 190 | No |
| 7-d | 7 | 3.66 | 1100 | 24 | 155 | 189.9 | 187 | No |
| 8-a | 8 | 3.40 | 950 | 20 | 88 | 135.3 | 196 | No |
| 8-b | 8 | 3.40 | 1000 | 21 | 110 | 174.3 | 187 | No |
| 8-c | 8 | 3.40 | 1050 | 23 | 132 | 203.0 | 181 | No |
| 8-d | 8 | 3.40 | 1100 | 25 | 148 | 219.8 | 177 | No |

[1)] $R = Si + Al/2 + Mn/4 + 5 \times P$

[2)] $Y = 4.5 \times (225 - 33 \times R - 770/\sqrt{D})$

In Sample Nos. 5-a to 5-d, since the solid solution strengthening parameter R and the average grain size D (μm) did not satisfy the expression (19) as well as the solid solution strengthening parameter R was excessively high, the annealed hot bands were broken during cold rolling. In Sample No. 7-a, since the solid solution strengthening parameter R and the average grain size D (μm) did not satisfy the expression (19), the annealed hot band was broken during cold rolling. In the samples except for Sample Nos. 5-a to 5-d and Sample No. 7-a, the annealed hot bands were rolled without being broken by cold rolling.

Example 1

Steel Nos. 6, 7, and 8 shown in Table 1 were melted in a vacuum and were casted, and thereby slabs were manufactured. Hot bands having a thickness of 2.0 mm were manufactured by hot rolling the slabs. After that, in hot band annealing, the hot bands were heated to 1000° C., the temperature of the hot bands was kept at 1000° C. for 60 s, and then the hot bands were cooled from 1000° C. to room temperature so that the average cooling rate of each hot band was 1° C./s to 30° C./s in the range of 950° C. to 600° C. After that, cold bands having a thickness of 0.35 mm were manufactured by cold rolling the annealed hot bands. Furthermore, in final annealing, the cold bands were heated to 1050° C., the temperature of the cold bands was kept at 1050° C. for 1 s, and then the cold bands were cooled from 1050° C. to room temperature. As a result, non-oriented electrical steel sheets (Sample Nos. 6-e to 8-f) were manufactured. In Sample Nos. 6-f, 7-f, and 8-f, as shown in Table 4, in a heating stage in which the cold bands were heated to 1050° C., the temperature of the cold bands was kept at 600° C. for 20 s.

In a similar manner of (Reference Experiment 1), the high-frequency core loss $W_{10/400}$ (W/kg) and the ratio of twin formation of the manufactured non-oriented electrical steel sheets were measured. Furthermore, pole figures were measured using an X-ray diffractometer at each thickness position near the surface and at the center of thickness of the non-oriented electrical steel sheets. I{100}/I{111} was determined by calculating the ODF near the surface and the ODF at the center of thickness from the pole figures, and averaging the ODFs. Table 4 shows the results of $W_{10/400}$, the ratio of twin formation, and I{100}/I{111}. In addition, in all Sample Nos., the average grain size of the non-oriented electrical steel sheets was about 100 μm.

TABLE 4

| Sample No. | Steel No. | X[1)] | R[2)] | ρ (×10⁻⁸ [Q · m]) | D [μm] | Y[3)] | Average Cooling Rate [° C./s] | Final Annealing Condition | I{100}/I{111} | Ratio of Twin Formation [%] | $W_{10/400}$ [W/kg] | Remarks Column |
|---|---|---|---|---|---|---|---|---|---|---|---|---|
| 6-e | 6 | 0.38 | 3.78 | 61.8 | 120 | 133.8 | 20 | 1050° C. × 1 s | 0.48 | 16 | 14.7 | Comparative Example |
| 6-f | 6 | 0.38 | 3.78 | 61.8 | 120 | 133.8 | 20 | 60° C. × 20 s→1050° C. × 1 s | 0.45 | 15 | 14.7 | Comparative Example |
| 7-e | 7 | 0.54 | 3.66 | 61.8 | 120 | 151.9 | 20 | 1050° C. × 1 s | 1.45 | 16 | 14.7 | Comparative Example |
| 7-f | 7 | 0.54 | 3.66 | 61.8 | 120 | 151.9 | 20 | 600° C. × 20 s→1050° C. × 1 s | 1.10 | 5 | 14.1 | Inventive Example |
| 8-e | 8 | 0.54 | 3.40 | 61.5 | 110 | 174.3 | 21 | 1050° C. × 1 s | 1.43 | 10 | 14.7 | Comparative Example |

TABLE 4-continued

| Sample No. | Steel No. | X[1)] | R[2)] | ρ (×10⁻⁸ [Ω · m]) | D [μm] | Y[3)] | Average Cooling Rate [° C./s] | Final Annealing Condition | I{100}/I{111} | Ratio of Twin Formation [%] | $W_{10/400}$ [W/kg] | Remarks Column |
|---|---|---|---|---|---|---|---|---|---|---|---|---|
| 8-f | 8 | 0.54 | 3.40 | 61.5 | 110 | 174.3 | 21 | 600° C. × 20 s→1050° C. × 1 s | 1.03 | 3 | 14.0 | Inventive Example |

※1)X = Al/(Si + Al + 0.5 × Mn)
※2)R = Si + Al/2 + Mn/4 + 5 × P
※3)Y = 4.5 × (225 − 33 × R − 77/√D)

For example, as can be understood from the comparison between Sample No. 7-f and Sample No. 7-e, in steel having a X value of 0.50 or more (Steel Nos. 7 and 8), when a heating stage of the final annealing included an intermediate holding in which the temperature of a cold band was kept at 600° C. for 20 s, the core loss decreased significantly. In addition, the intermediate holding decreased I{100}/I{111}, and thereby the ratio of twin formation was reduced. The detail reason why the ratio of twin formation decreased is not clear. It is thought that I{100}/I{111} influenced the formation of deformation twinning because the deformation twinning forms along a <111> direction of a {211} plane. As a result, it is thought that the formation of deformation twinning was inhibited during punching by the texture in which I{100}/I{111} was 0.50 to 1.40.

On the other hand, as can be understood from the comparison between Sample No. 6-f and Sample No. 6-e, in steel having a X value of less than 0.50 (Steel No. 6), even when a heating stage of the final annealing included an intermediate holding in which the temperature of a cold band was kept at 600° C. for 20 s, I{100}/I{111}, the ratio of twin formation, and the core loss were hardly changed.

Thus, when the temperature of a cold band having a X value of 0.50 or more is kept at a constant temperature in a range of 550° C. to 700° C. for 10 s to 300 s in a heating stage of finish annealing, it is possible to obtain the texture in which I{100}/I{111} is 0.50 to 1.40. On the other hand, when X is less than 0.50 or when the temperature of a cold band is not kept at a constant temperature in a range of 550° C. to 700° C. for 10 s to 300 s, it is impossible to obtain the texture in which I{100}/I{111} is 0.50 to 1.40.

Example 2

Steel Nos. 11 to 65 each having chemical composition shown in the following Table 5 and Table 6 were melted in a vacuum and were casted, thereby slabs were manufactured. Hot bands having a thickness of 2.0 mm were manufactured by hot rolling the slabs. After that, in hot band annealing, the hot bands were heated to 1000° C., the temperature of the hot bands was kept at 1000° C. or 1050° C. for 60 s, and then the hot bands were cooled from 1000° C. to room temperature so that the average cooling rate of each hot band was the corresponding value shown in the following Table 7 or Table 8 in the range of 950° C. to 600° C. The average grain size of the annealed hot bands (the average grain size of a steel sheet immediately before cold rolling) D (μm) was measured. Table 7 and Table 8 show the average grain size D (μm).

After that, cold bands having a thickness of 0.35 mm were manufactured by cold rolling the annealed hot bands. The number of passes was 6 in the cold rolling. The reduction of first pass was 20%, the total reduction from first pass to second pass was 50%, and the total reduction was 82.5%. Furthermore, in a heating stage of finish annealing, the cold bands were heated to 600° C., the temperature of the cold bands was kept at 600° C. for 20 s, and then the cold bands were heated to 1050° C. After that, in a subsequent stage of the finish annealing, the heated cold bands were held at 1050° C. for 1 s. As a result, non-oriented electrical steel sheets (Sample Nos. 11 to 65) were manufactured.

A single sheet 55 mm square was punched out from the non-oriented electrical steel sheet, and the specific resistance at room temperature ρ (Ω·m) of the single sheet was measured. In addition, the magnetic flux density $B_{50}$ at a magnetizing force of 5000 A/m (T) and $W_{10/400}$ (W/kg) of the single sheet were measured. Table 9 and Table 10 show the results of ρ (Ω·m), $B_{50}$ (T), and $W_{10/400}$ (W/kg). In addition, in all Sample Nos., the average grain size of non-oriented electrical steel sheets was about 100 μm.

TABLE 5

| Steel | Chemical Composition [mass %] (Balance: Fe and Other Impurities) | | | | | | | | | | Remarks |
|---|---|---|---|---|---|---|---|---|---|---|---|
| No. | Si | Mn | Al | P | C | S | N | X[1)] | R[2)] | E[3)] | Column |
| 11 | 0.30 | 1.00 | 2.39 | 0.054 | 0.0012 | 0.0011 | 0.0021 | 0.75 | 2.02 | 3.2 | Comparative Example |
| 12 | 0.30 | 1.00 | 2.39 | 0.062 | 0.0012 | 0.0011 | 0.0022 | 0.75 | 2.06 | 3.2 | Comparative Example |
| 13 | 0.30 | 1.00 | 2.39 | 0.087 | 0.0011 | 0.0009 | 0.0022 | 0.75 | 2.18 | 3.2 | Comparative Example |
| 14 | 0.30 | 1.00 | 2.39 | 0.094 | 0.0010 | 0.0008 | 0.0020 | 0.75 | 2.22 | 3.2 | Comparative Example |
| 15 | 2.76 | 0.19 | 1.83 | 0.052 | 0.0020 | 0.0011 | 0.0021 | 0.39 | 3.98 | 4.7 | Comparative Example |
| 16 | 2.76 | 0.19 | 1.83 | 0.061 | 0.0018 | 0.0012 | 0.0023 | 0.39 | 4.03 | 4.7 | Comparative Example |
| 17 | 2.76 | 0.19 | 1.83 | 0.089 | 0.0017 | 0.0011 | 0.0021 | 0.39 | 4.17 | 4.7 | Comparative Example |

TABLE 5-continued

| Steel | Chemical Composition [mass %] (Balance: Fe and Other Impurities) | | | | | | | | | | Remarks |
|---|---|---|---|---|---|---|---|---|---|---|---|
| No. | Si | Mn | Al | P | C | S | N | X[1)] | R[2)] | E[3)] | Column |
| 18 | 2.76 | 0.19 | 1.83 | 0.097 | 0.0018 | 0.0013 | 0.0020 | 0.39 | 4.21 | 4.7 | Comparative Example |
| 19 | 1.40 | 3.10 | 1.59 | 0.052 | 0.0011 | 0.0011 | 0.0021 | 0.35 | 3.23 | 4.5 | Comparative Example |
| 20 | 1.40 | 3.11 | 1.60 | 0.061 | 0.0018 | 0.0012 | 0.0023 | 0.35 | 3.28 | 4.6 | Comparative Example |
| 21 | 1.40 | 3.14 | 1.58 | 0.086 | 0.0010 | 0.0012 | 0.0018 | 0.35 | 3.41 | 4.6 | Comparative Example |
| 22 | 1.40 | 3.11 | 1.61 | 0.095 | 0.0019 | 0.0011 | 0.0021 | 0.35 | 3.46 | 4.6 | Comparative Example |
| 23 | 1.34 | 3.10 | 0.89 | 0.051 | 0.0019 | 0.0010 | 0.0022 | 0.24 | 2.82 | 3.8 | Comparative Example |
| 24 | 1.34 | 3.10 | 0.88 | 0.060 | 0.0018 | 0.0010 | 0.0021 | 0.23 | 2.86 | 3.8 | Comparative Example |
| 25 | 1.33 | 3.12 | 0.87 | 0.086 | 0.0017 | 0.0012 | 0.0018 | 0.23 | 2.98 | 3.8 | Comparative Example |
| 26 | 1.33 | 3.12 | 0.88 | 0.096 | 0.0018 | 0.0012 | 0.0019 | 0.23 | 3.03 | 3.8 | Comparative Example |
| 27 | 1.10 | 1.30 | 2.89 | 0.053 | 0.0018 | 0.0009 | 0.0020 | 0.62 | 3.14 | 4.6 | Comparative Example |
| 28 | 1.10 | 1.33 | 2.88 | 0.064 | 0.0018 | 0.0008 | 0.0021 | 0.62 | 3.19 | 4.6 | Comparative Example |
| 29 | 1.11 | 1.31 | 2.86 | 0.083 | 0.0019 | 0.0008 | 0.0022 | 0.62 | 3.28 | 4.6 | Comparative Example |
| 30 | 1.12 | 1.30 | 2.87 | 0.095 | 0.0020 | 0.0009 | 0.0023 | 0.62 | 3.36 | 4.6 | Comparative Example |
| 31 | 1.90 | 0.50 | 2.50 | 0.012 | 0.0018 | 0.0011 | 0.0019 | 0.54 | 3.34 | 4.7 | Comparative Example |
| 32 | 0.61 | 2.88 | 2.39 | 0.052 | 0.0011 | 0.0011 | 0.0021 | 0.54 | 2.79 | 4.4 | Inventive Example |
| 33 | 0.63 | 2.93 | 2.35 | 0.062 | 0.0010 | 0.0009 | 0.0021 | 0.53 | 2.85 | 4.4 | Inventive Example |
| 34 | 0.59 | 2.94 | 2.38 | 0.087 | 0.0009 | 0.0010 | 0.0019 | 0.54 | 2.95 | 4.4 | Inventive Example |
| 35 | 0.58 | 2.91 | 2.42 | 0.095 | 0.0012 | 0.0010 | 0.0020 | 0.54 | 2.99 | 4.5 | Inventive Example |
| 36 | 0.62 | 2.92 | 2.59 | 0.051 | 0.0011 | 0.0013 | 0.0018 | 0.55 | 2.90 | 4.7 | Inventive Example |
| 37 | 0.57 | 2.94 | 2.57 | 0.063 | 0.0010 | 0.0011 | 0.0019 | 0.56 | 2.91 | 4.6 | Inventive Example |
| 38 | 0.64 | 2.86 | 2.62 | 0.086 | 0.0010 | 0.0012 | 0.0018 | 0.56 | 3.10 | 4.7 | Inventive Example |

1) X = Al/(Si + Al + 0.5 × Mn)
2) R = Si + Al/2 + Mn/4 + 5 × P
3) E = Si + Al + 0.5 × Mn

TABLE 6

| Steel | Chemical Composition [mass %] (Balance: Fe and Other Impurities) | | | | | | | | | | Remarks |
|---|---|---|---|---|---|---|---|---|---|---|---|
| No. | Si | Mn | Al | P | C | S | N | X[1)] | R[2)] | E[3)] | Column |
| 39 | 0.56 | 2.88 | 2.61 | 0.098 | 0.0019 | 0.0010 | 0.0019 | 0.57 | 3.08 | 4.6 | Inventive Example |
| 40 | 1.00 | 2.87 | 2.50 | 0.054 | 0.0018 | 0.0012 | 0.0020 | 0.51 | 3.24 | 4.9 | Inventive Example |
| 41 | 0.90 | 2.86 | 2.40 | 0.062 | 0.0018 | 0.0012 | 0.0021 | 0.51 | 3.13 | 4.7 | Inventive Example |
| 42 | 0.92 | 2.88 | 2.42 | 0.087 | 0.0019 | 0.0012 | 0.0021 | 0.51 | 3.29 | 4.8 | Inventive Example |
| 43 | 0.89 | 2.91 | 2.41 | 0.094 | 0.0018 | 0.0011 | 0.0023 | 0.51 | 3.29 | 4.8 | Inventive Example |
| 44 | 1.27 | 1.91 | 2.57 | 0.051 | 0.0020 | 0.0010 | 0.0019 | 0.54 | 3.29 | 4.8 | Inventive Example |
| 45 | 1.33 | 1.92 | 2.56 | 0.063 | 0.0021 | 0.0010 | 0.0022 | 0.53 | 3.41 | 4.9 | Inventive Example |
| 46 | 1.34 | 1.88 | 2.63 | 0.089 | 0.0020 | 0.0010 | 0.0021 | 0.54 | 3.57 | 4.9 | Inventive Example |
| 47 | 1.26 | 1.89 | 2.61 | 0.095 | 0.0019 | 0.0011 | 0.0021 | 0.54 | 3.51 | 4.8 | Inventive Example |

TABLE 6-continued

| Steel No. | Chemical Composition [mass %] (Balance: Fe and Other Impurities) Si | Mn | Al | P | C | S | N | X[1)] | R[2)] | E[3)] | Remarks Column |
|---|---|---|---|---|---|---|---|---|---|---|---|
| 48 | 1.66 | 1.50 | 2.60 | 0.051 | 0.0021 | 0.0011 | 0.0023 | 0.52 | 3.59 | 5.0 | Inventive Example |
| 49 | 1.65 | 1.45 | 2.55 | 0.064 | 0.0022 | 0.0012 | 0.0018 | 0.52 | 3.61 | 4.9 | Inventive Example |
| 50 | 1.69 | 1.48 | 2.53 | 0.084 | 0.0021 | 0.0013 | 0.0019 | 0.51 | 3.75 | 5.0 | Inventive Example |
| 51 | 1.72 | 1.43 | 2.58 | 0.097 | 0.0023 | 0.0011 | 0.0018 | 0.51 | 3.85 | 5.0 | Inventive Example |
| 52 | 1.66 | 1.00 | 2.41 | 0.052 | 0.0018 | 0.0009 | 0.0020 | 0.53 | 3.38 | 4.6 | Inventive Example |
| 53 | 1.68 | 1.03 | 2.40 | 0.065 | 0.0020 | 0.0009 | 0.0021 | 0.52 | 3.46 | 4.6 | Inventive Example |
| 54 | 1.69 | 1.03 | 2.43 | 0.051 | 0.0019 | 0.0009 | 0.0023 | 0.52 | 3.42 | 4.6 | Inventive Example |
| 55 | 1.70 | 1.04 | 2.40 | 0.053 | 0.0021 | 0.0011 | 0.0023 | 0.52 | 3.43 | 4.6 | Inventive Example |
| 56 | 1.72 | 0.79 | 2.39 | 0.052 | 0.0022 | 0.0011 | 0.0021 | 0.53 | 3.37 | 4.5 | Inventive Example |
| 57 | 1.71 | 0.81 | 2.40 | 0.096 | 0.0019 | 0.0011 | 0.0020 | 0.53 | 3.59 | 4.5 | Inventive Example |
| 58 | 1.73 | 0.83 | 2.62 | 0.051 | 0.0022 | 0.0010 | 0.0018 | 0.55 | 3.50 | 4.8 | Inventive Example |
| 59 | 1.72 | 0.84 | 2.61 | 0.095 | 0.0020 | 0.0012 | 0.0023 | 0.55 | 3.71 | 4.8 | Inventive Example |
| 60 | 1.74 | 0.82 | 2.42 | 0.062 | 0.0019 | 0.0012 | 0.0019 | 0.53 | 3.47 | 4.6 | Inventive Example |
| 61 | 1.73 | 0.81 | 2.41 | 0.087 | 0.0018 | 0.0011 | 0.0022 | 0.53 | 3.57 | 4.5 | Inventive Example |
| 62 | 1.71 | 0.81 | 2.64 | 0.063 | 0.0018 | 0.0011 | 0.0021 | 0.56 | 3.55 | 4.8 | Inventive Example |
| 63 | 1.70 | 0.80 | 2.63 | 0.089 | 0.0021 | 0.0011 | 0.0021 | 0.56 | 3.66 | 4.7 | Inventive Example |
| 64 | 1.10 | 1.90 | 2.67 | 0.051 | 0.0020 | 0.0012 | 0.0019 | 0.57 | 3.17 | 4.7 | Inventive Example |
| 65 | 1.10 | 1.88 | 2.65 | 0.062 | 0.0019 | 0.0010 | 0.0018 | 0.57 | 3.21 | 4.7 | Inventive Example |

X[1)] $X = Al/(Si + Al + 0.5 \times Mn)$
X[2)] $R = Si + Al/2 + Mn/4 + 5 \times P$
X[3)] $E = Si + Al + 0.5 \times Mn$

TABLE 7

| Sample No. | Steel No. | Hot Band Annealing Condition | Average Cooling Rate [° C./s] | D [μm] | Y[1)] | Remarks Column |
|---|---|---|---|---|---|---|
| 11 | 11 | 1050° C. × 60 s | 25 | 131 | 411 | Comparative Example |
| 12 | 12 | 1050° C. × 60 s | 24 | 132 | 406 | Comparative Example |
| 13 | 13 | 1050° C. × 60 s | 26 | 134 | 389 | Comparative Example |
| 14 | 14 | 1050° C. × 60 s | 27 | 128 | 377 | Comparative Example |
| 15 | 15 | 1000° C. × 60 s | 21 | 124 | 110 | Comparative Example |
| 16 | 16 | 1000° C. × 60 s | 22 | 131 | 112 | Comparative Example |
| 17 | 17 | 1000° C. × 60 s | 24 | 124 | 82 | Comparative Example |
| 18 | 18 | 1000° C. × 60 s | 21 | 129 | 83 | Comparative Example |
| 19 | 19 | 1000° C. × 60 s | 21 | 115 | 210 | Comparative Example |
| 20 | 20 | 1000° C. × 60 s | 26 | 113 | 199 | Comparative Example |
| 21 | 21 | 1000° C. × 60 s | 24 | 110 | 176 | Comparative Example |
| 22 | 22 | 1000° C. × 60 s | 23 | 110 | 169 | Comparative Example |
| 23 | 23 | 1000° C. × 60 s | 24 | 120 | 278 | Comparative Example |
| 24 | 24 | 1000° C. × 60 s | 25 | 123 | 276 | Comparative Example |
| 25 | 25 | 1000° C. × 60 s | 24 | 130 | 267 | Comparative Example |
| 26 | 26 | 1000° C. × 60 s | 26 | 128 | 256 | Comparative Example |
| 27 | 27 | 1050° C. × 60 s | 20 | 130 | 243 | Comparative Example |
| 28 | 28 | 1050° C. × 60 s | 22 | 135 | 240 | Comparative Example |
| 29 | 29 | 1050° C. × 60 s | 20 | 134 | 226 | Comparative Example |
| 30 | 30 | 1050° C. × 60 s | 21 | 133 | 214 | Comparative Example |
| 31 | 31 | 1000° C. × 60 s | 22 | 130 | 213 | Comparative Example |
| 32 | 32 | 1050° C. × 60 s | 20 | 120 | 283 | Inventive Example |
| 33 | 33 | 1050° C. × 60 s | 18 | 121 | 275 | Inventive Example |
| 34 | 34 | 1050° C. × 60 s | 23 | 119 | 257 | Inventive Example |
| 35 | 35 | 1050° C. × 60 s | 22 | 118 | 249 | Inventive Example |

TABLE 7-continued

| Sample No. | Steel No. | Hot Band Annealing Condition | Average Cooling Rate [° C./s] | D [μm] | Y[1)] | Remarks Column |
|---|---|---|---|---|---|---|
| 36 | 36 | 1050° C. × 60 s | 20 | 122 | 268 | Inventive Example |
| 37 | 37 | 1050° C. × 60 s | 23 | 124 | 270 | Inventive Example |
| 38 | 38 | 1050° C. × 60 s | 24 | 117 | 233 | Inventive Example |

※[1)]Y = 4.5 × (225 − 33 × R − 770/$\sqrt{D}$)

TABLE 8

| Sample No. | Steel No. | Hot Band Annealing Condition | Average Cooling Rate [° C./s] | D [μm] | Y[1)] | Remarks Column |
|---|---|---|---|---|---|---|
| 39 | 39 | 1050° C. × 60 s | 21 | 125 | 246 | Inventive Example |
| 40 | 40 | 1050° C. × 60 s | 17 | 122 | 218 | Inventive Example |
| 41 | 41 | 1050° C. × 60 s | 18 | 121 | 233 | Inventive Example |
| 42 | 42 | 1050° C. × 60 s | 17 | 130 | 221 | Inventive Example |
| 43 | 43 | 1050° C. × 60 s | 16 | 126 | 215 | Inventive Example |
| 44 | 44 | 1050° C. × 60 s | 19 | 120 | 208 | Inventive Example |
| 45 | 45 | 1050° C. × 60 s | 20 | 124 | 196 | Inventive Example |
| 46 | 46 | 1050° C. × 60 s | 22 | 115 | 159 | Inventive Example |
| 47 | 47 | 1050° C. × 60 s | 21 | 118 | 172 | Inventive Example |
| 48 | 48 | 1000° C. × 60 s | 24 | 134 | 180 | Inventive Example |
| 49 | 49 | 1000° C. × 60 s | 22 | 132 | 175 | Inventive Example |
| 50 | 50 | 1000° C. × 60 s | 23 | 131 | 154 | Inventive Example |
| 51 | 51 | 1000° C. × 60 s | 23 | 131 | 138 | Inventive Example |
| 52 | 52 | 1050° C. × 60 s | 18 | 128 | 205 | Inventive Example |
| 53 | 53 | 1050° C. × 60 s | 19 | 131 | 196 | Inventive Example |
| 54 | 54 | 1050° C. × 60 s | 17 | 132 | 203 | Inventive Example |
| 55 | 55 | 1000° C. × 60 s | 24 | 133 | 203 | Inventive Example |
| 56 | 56 | 1050° C. × 60 s | 24 | 124 | 201 | Inventive Example |
| 57 | 57 | 1050° C. × 60 s | 23 | 123 | 167 | Inventive Example |
| 58 | 58 | 1050° C. × 60 s | 22 | 125 | 182 | Inventive Example |
| 59 | 59 | 1050° C. × 60 s | 21 | 123 | 149 | Inventive Example |
| 60 | 60 | 1050° C. × 60 s | 20 | 122 | 184 | Inventive Example |
| 61 | 61 | 1050° C. × 60 s | 20 | 121 | 167 | Inventive Example |
| 62 | 62 | 1050° C. × 60 s | 21 | 130 | 182 | Inventive Example |
| 63 | 63 | 1050° C. × 60 s | 23 | 126 | 160 | Inventive Example |
| 64 | 64 | 1000° C. × 60 s | 22 | 120 | 226 | Inventive Example |
| 65 | 65 | 1000° C. × 60 s | 23 | 130 | 233 | Inventive Example |

※[1)]Y = 4.5 × (225 − 33 × R − 770/$\sqrt{D}$)

TABLE 9

| Sample No. | Steel No. | ρ ($\times 10^{-8}$[Ω · m]) | I{100}/I{111} | Ratio of Twin Formation [%} | $B_{50}$ [T] | $W_{10/400}$ [W/kg] | Remarks Column |
|---|---|---|---|---|---|---|---|
| 11 | 11 | 44.1 | 0.53 | 0 | 1.686 | 15.5 | Comparative Example |
| 12 | 12 | 44.1 | 0.59 | 0 | 1.687 | 15.5 | Comparative Example |
| 13 | 13 | 44.1 | 0.65 | 0 | 1.689 | 15.4 | Comparative Example |
| 14 | 14 | 44.1 | 0.69 | 0 | 1.690 | 15.4 | Comparative Example |
| 15 | 15 | 63.7 | | Rupture | | | Comparative Example |
| 16 | 16 | 63.7 | | Rupture | | | Comparative Example |
| 17 | 17 | 63.7 | | Rupture | | | Comparative Example |
| 18 | 18 | 63.7 | | Rupture | | | Comparative Example |
| 19 | 19 | 63.6 | 0.33 | 22 | 1.650 | 14.9 | Comparative Example |
| 20 | 20 | 63.8 | 0.39 | 25 | 1.651 | 14.8 | Comparative Example |
| 21 | 21 | 63.8 | 0.45 | 26 | 1.653 | 14.8 | Comparative Example |
| 22 | 22 | 63.9 | 0.48 | 28 | 1.654 | 14.6 | Comparative Example |
| 23 | 23 | 55.9 | 0.31 | 8 | 1.654 | 15.5 | Comparative Example |
| 24 | 24 | 55.8 | 0.38 | 8 | 1.655 | 15.4 | Comparative Example |
| 25 | 25 | 55.7 | 0.39 | 7 | 1.658 | 15.3 | Comparative Example |
| 26 | 26 | 55.8 | 0.45 | 7 | 1.659 | 15.3 | Comparative Example |
| 27 | 27 | 61.0 | 1.42 | 21 | 1.610 | 14.7 | Comparative Example |
| 28 | 28 | 61.1 | 1.48 | 22 | 1.610 | 14.9 | Comparative Example |
| 29 | 29 | 60.9 | 1.56 | 24 | 1.610 | 15.0 | Comparative Example |
| 30 | 30 | 61.1 | 1.58 | 26 | 1.620 | 15.0 | Comparative Example |

TABLE 9-continued

| Sample No. | Steel No. | ρ ($\times 10^{-8}$[Ω · m]) | I{100}/I{111} | Ratio of Twin Formation [%} | $B_{50}$ [T] | $W_{10/400}$ [W/kg] | Remarks Column |
|---|---|---|---|---|---|---|---|
| 31 | 31 | 61.8 | 0.72 | 10 | 1.620 | 15.2 | Comparative Example |
| 32 | 32 | 60.4 | 0.63 | 5 | 1.647 | 14.3 | Inventive Example |
| 33 | 33 | 60.6 | 0.68 | 6 | 1.649 | 14.2 | Inventive Example |
| 34 | 34 | 60.4 | 0.71 | 6 | 1.651 | 14.1 | Inventive Example |
| 35 | 35 | 60.5 | 0.72 | 7 | 1.650 | 14.1 | Inventive Example |
| 36 | 36 | 62.8 | 0.71 | 8 | 1.636 | 14.1 | Inventive Example |
| 37 | 37 | 62.1 | 0.74 | 8 | 1.639 | 14.1 | Inventive Example |
| 38 | 38 | 62.9 | 0.73 | 9 | 1.639 | 14.0 | Inventive Example |

TABLE 10

| Sample No. | Steel No. | ρ ($\times 10^{-8}$[Ω · m]) | I{100}/I{111} | Ratio of Twin Formation [%} | $B_{50}$ [T] | $W_{10/400}$ [W/kg] | Remarks Column |
|---|---|---|---|---|---|---|---|
| 39 | 39 | 62.0 | 0.82 | 9 | 1.642 | 14.0 | Inventive Example |
| 40 | 40 | 66.2 | 0.84 | 8 | 1.627 | 13.9 | Inventive Example |
| 41 | 41 | 63.9 | 0.90 | 9 | 1.628 | 13.8 | Inventive Example |
| 42 | 42 | 64.5 | 0.94 | 9 | 1.629 | 13.8 | Inventive Example |
| 43 | 43 | 64.2 | 1.03 | 10 | 1.630 | 13.9 | Inventive Example |
| 44 | 44 | 64.0 | 1.08 | 9 | 1.625 | 14.1 | Inventive Example |
| 45 | 45 | 64.7 | 1.14 | 9 | 1.635 | 14.1 | Inventive Example |
| 46 | 46 | 65.2 | 1.18 | 9 | 1.625 | 14.0 | Inventive Example |
| 47 | 47 | 64.1 | 1.18 | 10 | 1.638 | 14.0 | Inventive Example |
| 48 | 48 | 66.4 | 1.25 | 11 | 1.669 | 14.0 | Inventive Example |
| 49 | 49 | 65.4 | 1.29 | 15 | 1.669 | 14.2 | Inventive Example |
| 50 | 50 | 65.9 | 1.29 | 16 | 1.670 | 14.3 | Inventive Example |
| 51 | 51 | 66.5 | 1.31 | 18 | 1.669 | 14.3 | Inventive Example |
| 52 | 52 | 61.2 | 1.33 | 10 | 1.631 | 14.3 | Inventive Example |
| 53 | 53 | 61.5 | 1.15 | 8 | 1.632 | 13.8 | Inventive Example |
| 54 | 54 | 62.0 | 1.16 | 10 | 1.622 | 13.8 | Inventive Example |
| 55 | 55 | 61.8 | 1.20 | 13 | 1.664 | 14.1 | Inventive Example |
| 56 | 56 | 60.3 | 1.25 | 14 | 1.648 | 14.2 | Inventive Example |
| 57 | 57 | 60.5 | 1.26 | 10 | 1.652 | 14.1 | Inventive Example |
| 58 | 58 | 63.0 | 1.30 | 11 | 1.636 | 14.1 | Inventive Example |
| 59 | 59 | 62.9 | 1.32 | 12 | 1.641 | 14.0 | Inventive Example |
| 60 | 60 | 61.1 | 1.35 | 14 | 1.647 | 14.1 | Inventive Example |
| 61 | 61 | 60.8 | 1.20 | 5 | 1.650 | 14.1 | Inventive Example |
| 62 | 62 | 62.9 | 1.24 | 8 | 1.637 | 14.1 | Inventive Example |
| 63 | 63 | 62.6 | 1.21 | 8 | 1.641 | 14.0 | Inventive Example |
| 64 | 64 | 62.8 | 1.26 | 8 | 1.657 | 14.1 | Inventive Example |
| 65 | 65 | 62.4 | 1.34 | 7 | 1.658 | 14.0 | Inventive Example |

In Sample Nos. 11 to 14, since the amount of Si, ρ, and E were excessively small, $W_{10/400}$ was large. In Sample Nos. 15 to 18, since R did not satisfy the expression (15) as well as the amount of Si was excessively large, the steel sheet was broken during cold rolling. In addition, in Sample Nos. 19 to 22, since X did not satisfy the expression (12) and I{100}/I{111} did not satisfy the expression (18) as well as the amount of Mn was excessively high, $W_{10/400}$ was large. In Sample Nos. 23 to 26, since the chemical composition and texture were inappropriate, $W_{10/400}$ was large. In these Sample Nos., ρ was low and E was small as well as the amount of Mn was excessively high and the amount of Al was excessively small. Furthermore, X did not satisfy the expression (12), and I{100}/I{111} did not satisfy the expression (18). In Sample Nos. 27 to 30, I{100}/I{111} did not satisfy the expression (18) as well as the amount of Al was excessively large, $W_{10/400}$ was large. In Sample No. 31, since the amount of P was excessively low, $W_{10/400}$ was large.

On the other hand, in Sample Nos. 32 to 65, since the chemical composition of steel and manufacturing condition were appropriate, the producibility (yield and productivity) was excellent in cold rolling. In addition, in these Sample Nos., since the specific resistance and texture of the steel sheets were appropriate, $W_{10/400}$ was small.

FIG. 2 is a graph which is made from data of Sample Nos. 19 to 22, 27 to 30, and 32 to 65, and shows the relationship between I{100}/I{111} and $W_{10/400}$. As can be understood from FIG. 2, when I{100}/I{111} is in a range of 0.5 to 1.4, it is possible to decrease $W_{10/400}$ to a minimum limit.

INDUSTRIAL APPLICABILITY

According to the present invention, it is possible to provide an inexpensive non-oriented electrical steel sheet in which the high-frequency core loss is further improved and a method for manufacturing thereof. Therefore, the industrial applicability of the present invention is high.

What is claimed is:

1. A non-oriented electrical steel sheet having a chemical composition comprising:

C: 0 to 0.0050 mass %,

Si: 0.50 to 2.70 mass %,

Mn: 0.10 to 3.00 mass %,

Al: 2.35 to 2.70 mass %,
P: 0.050 to 0.100 mass %,
S: 0 to 0.0060 mass %,
N: 0 to 0.0050 mass %,
Ti: 0 to 0.008 mass %,
V: 0 to 0.008 mass %,
Nb: 0 to 0.008 mass %,
Zr: 0 to 0.008 mass %, and
a balance: Fe and impurities, wherein
the chemical composition satisfies a following expression (1), a following expression (2), and a following expression (3),
an intensity of a {100} plane I{100} and an intensity of a {111} plane I{111} satisfy a following expression (4), the intensity I{100} and the intensity I{111} being determined by calculating an average of an orientation determination function near a surface and an orientation determination function at a thickness center using pole figures measured by an X-ray diffraction method,
a specific resistance is $60.0\times10^{-8}$ Ω·m or higher at room temperature,
a thickness is 0.05 mm to 0.40 mm, $$0.50\leq Al/(Si+A1+0.5\times Mn)\leq 0.83 \quad (1),$$

$$1.28\leq Si+Al/2+Mn/4+5\times P\leq 3.90 \quad (2),$$

$$4.0\leq Si+Al+0.5\times Mn\leq 7.0 \quad (3), \text{ and}$$

$$0.50\leq I\{100\}/I\{111\}\leq 1.18 \quad (4),$$

wherein in expressions (1) to (3) the chemical symbols indicate the amounts of the corresponding chemical elements in mass %.

2. The non-oriented electrical steel sheet according to claim 1, wherein
a number ratio of twin formation is 10% or less, when a single sheet 55 mm square is punched out from the non-oriented electrical steel sheet, a photograph of a surface formed by punching is taken with an optical microscope at 50 times magnification, and a number of crystal grains including deformation twinning is counted in 300 crystal grains or more selected from the photograph.

3. The non-oriented electrical steel sheet according to claim 2, wherein
a high-frequency core loss W10/400 is 14.3 W/kg or less.

4. The non-oriented electrical steel sheet according to claim 3, wherein
the high-frequency core loss W10/400 is 14.0 W/kg or less.

5. The non-oriented electrical steel sheet according to claim 1, wherein
a high-frequency core loss W10/400 is 14.3 W/kg or less.

6. The non-oriented electrical steel sheet according to claim 5, wherein
the high-frequency core loss W10/400 is 14.0 W/kg or less.

7. A method for manufacturing the non-oriented electrical steel sheet according to claim 1, the method comprising:
a hot rolling step subjecting a slab to hot rolling to manufacture a hot band, the slab having a chemical composition comprising:
C: 0 to 0.0050 mass %,
Si: 0.50 to 2.70 mass %,
Mn: 0.10 to 3.00 mass %,
Al: 2.35 to 2.70 mass %,
P: 0.050 to 0.100 mass %,
S: 0 to 0.0060 mass %,
N: 0 to 0.0050 mass %,
Ti: 0 to 0.008 mass %,
V: 0 to 0.008 mass %,
Nb: 0 to 0.008 mass %,
Zr: 0 to 0.008 mass %, and
a balance: Fe and impurities, and
the chemical composition satisfying a following expression (5), a following expression (6), and a following expression (7),
a cold rolling step subjecting the hot band to cold rolling after the hot rolling step to manufacturing a cold band having a thickness of 0.05 mm to 0.40 mm,
a final annealing step subjecting the cold band to final annealing after the cold rolling step, wherein
in the cold rolling step, an average grain size of the hot band before the cold rolling D (μm) and a solid solution strengthening parameter R calculated by a following expression (8) satisfy a following expression (9),
in a stage in which the cold band is heated in the final annealing step, a temperature of the cold band is maintained for 10 to 300 s at a constant temperature in a range of 550° C. to 700° C., $$0.50\leq Al/(Si+Al+0.50\times Mn)\leq 0.83 \quad (5),$$

$$1.28\leq Si+Al/2+Mn/4+5\times P\leq 3.90 \quad (6),$$

$$4.0\leq Si+Al+0.5\times Mn\leq 7.0 \quad (7),$$

$$R=Si+Al/2+Mn/4+5\times P \quad (8), \text{ and}$$

[Equation 1]

$$D < 4.5\times\left(225-33\times R-\frac{770}{\sqrt{D}}\right), \quad (9)$$

wherein in expressions (5) to (8) the chemical symbols indicate the amounts of the corresponding chemical elements in mass %.

8. The method for manufacturing the non-oriented electrical steel sheet according to claim 7, the method further comprising a hot band annealing step subjecting the hot band to hot band annealing between the hot rolling step and the cold rolling step.

* * * * *